United States Patent [19]

Wickersham

[11] 4,030,440

[45] June 21, 1977

[54] BOAT CLEANING MACHINE

[76] Inventor: Floyd David Wickersham, R.R. 1, Leesburg, Ind. 46538

[22] Filed: Mar. 24, 1976

[21] Appl. No.: 670,049

[52] U.S. Cl. ..... 114/222; 15/53 A
[51] Int. Cl.[2] ..... B63B 59/00
[58] Field of Search ..... 114/222; 15/21 R, 21 E, 15/53 A; 134/6, 34, 36; 9/1.1

[56] References Cited

UNITED STATES PATENTS

| | | | |
|---|---|---|---|
| 2,098,262 | 11/1937 | Temple | 114/222 |
| 2,104,062 | 1/1938 | Temple | 114/222 |
| 3,136,425 | 6/1964 | Greenbury | 9/1.1 |
| 3,773,059 | 11/1973 | Arneson | 114/222 |
| 3,928,064 | 12/1975 | Holm | 134/34 |

FOREIGN PATENTS OR APPLICATIONS

| | | | |
|---|---|---|---|
| 521,982 | 8/1953 | Belgium | 114/222 |

*Primary Examiner*—Trygve M. Blix
*Assistant Examiner*—Stuart M. Goldstein
*Attorney, Agent, or Firm*—Woodard, Weikart, Emhardt & Naughton

[57] ABSTRACT

A boat cleaning apparatus comprising framework for suspending a boat in the air, a frame having rotatable brushes positioned to clean a portion of the length of the sides and bottom of the boat, spray nozzles attached to the frame for directing an aqueous acid solution or steam against the boat, and wheels supporting the frame and enabling the frame to be moved along the length of the boat. The brushes rotate as the frame is moved along the length of the boat and thereby clean the full length of the sides and bottom of the boat.

11 Claims, 5 Drawing Figures

BOAT CLEANING MACHINE

BACKGROUND OF THE INVENTION

1. Field of the Invention

This invention relates to apparatus for cleaning the exterior of a boat when the boat has been removed from the water.

2. Description of the Prior Art

The problem of marine fouling is a continual one for all watercraft. Boats can quickly become coated below the waterline with barnacles, algae and other organisms and substances. The fouling initially is unsightly and may produce an unpleasant odor. As it increases, the effect of the fouling to decrease speed and increase fuel consumption becomes more pronounced.

Several apparatus have been designed for cleaning a boat while it floats in the water. Patents for such apparatus include U.S. Pat. Nos. 2,327,012 issued to Bright on Aug. 17, 1943; 3,561,391 issued to Locati on Feb. 9, 1971; 3,709,184 issued to Laney on Jan. 9, 1973; and 3,752,109 issued to Seiple on Aug. 14, 1973. These devices, however, have several limitations which limit their practicality and usefulness.

Each of these devices incorporates a brush which is mechanically driven to scrub the exterior of the boat. Because the boat is in the water, there are many moving parts which lie within the water. These parts are therefore quite susceptible to fouling, as is the boat. Fouling of these moving parts will have the effect of reducing efficiency of the equipment and increasing power consumption. Further problems arise in conjunction with increased wear. Operation of the systems below water also requires that the power source be located away from the driven brushes. This arrangement requires complex and expensive power transmission systems which also are susceptible to fouling and increased wear.

Another problem with boat cleaning devices which operate in the water is the inability to use a concentrated cleaning solution on the boat surface. The cleaning solution is quickly diluted by the water in which the boat is floating. An alternative is to dock the boat in a hull-sterilizing tank into which a chemical agent has been added. This alternative, however, provides a concentrated cleaning solution only by using large amounts of the solution. Further, the solution directly pollutes the water in which the tank is located, and there is a need to clean fouling from the tank itself.

SUMMARY OF THE INVENTION

A boat cleaning apparatus is disclosed herein comprising a frame having a first dimension parallel to the longitudinal axis of a boat suspended above it; bottom-cleaning means mounted upon the frame for cleaning the bottom of a boat, the bottom-cleaning means having a bottom-cleaning surface at least a portion of which is positioned to contact the bottom of a boat suspended above it, the bottom-cleaning surface being movable relative to a boat suspended adjacent thereto and relative to the frame; first drive means for moving the bottom-cleaning surface relative to a boat suspended adjacent thereto and relative to the frame; side-cleaning means mounted upon the frame for cleaning one side of a boat, the side-cleaning means having a side-cleaning surface at least a portion of which is positioned to contact a side of a boat suspended above the bottom-cleaning surface, the side-cleaning surface being movable relative to a boat suspended adjacent thereto and relative to the frame; second drive means for moving the side-cleaning surface relative to a boat suspended adjacent thereto and relative to the frame; and means for moving the frame along the first dimension of the frame parallel to the longitudinal axis of a boat suspended above the bottom-cleaning surface.

It is an object of this invention to provide an apparatus for efficiently cleaning the exterior of a boat.

It is a further object of this invention to provide an apparatus capable of employing a concentrated cleaning solution in cleaning the exterior of a boat.

Another object of this invention is to provide an apparatus for cleaning the exterior of a boat while it is removed from the water, particularly before it is in winter storage.

DESCRIPTION OF THE PREFERRED EMBODIMENT

Figure 1:
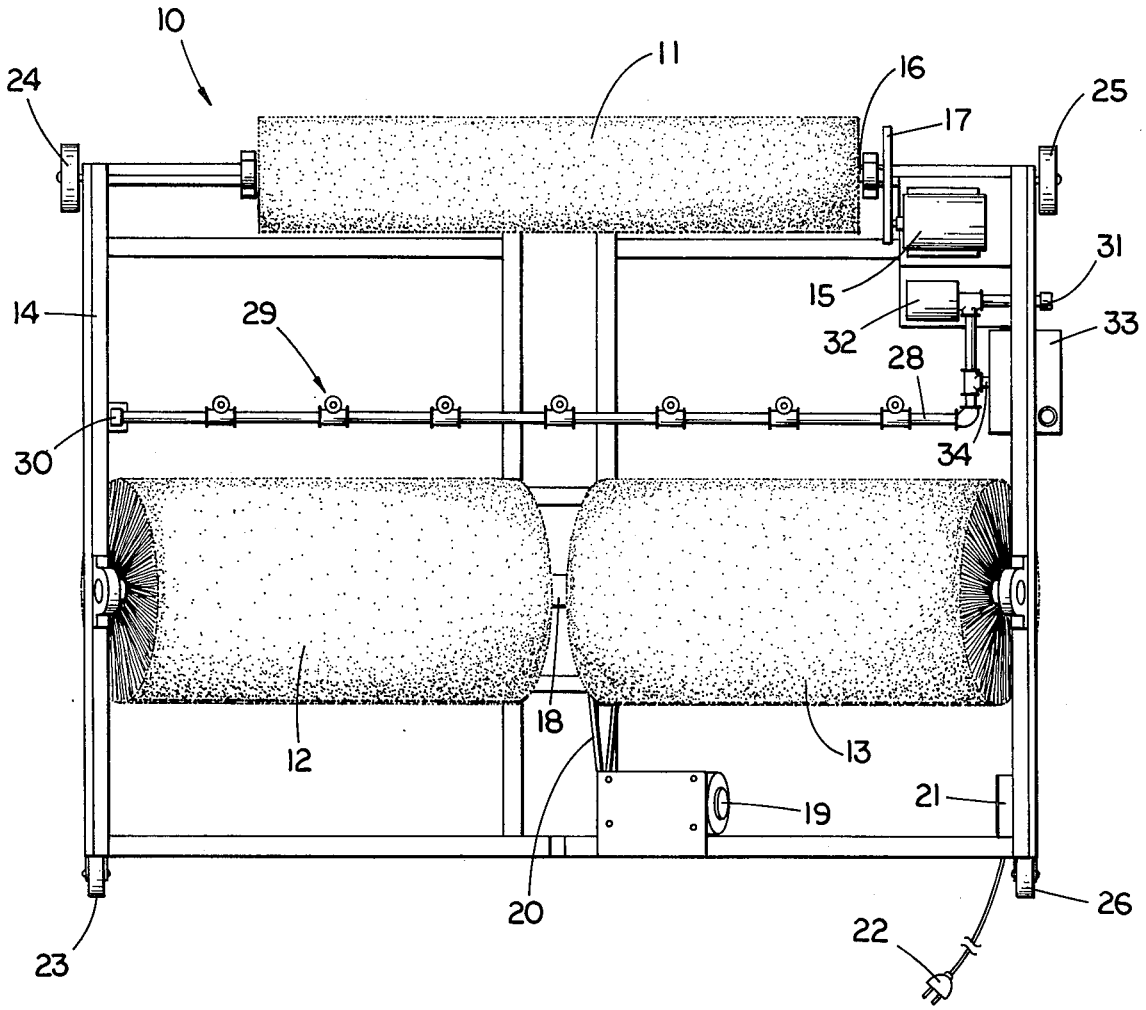
FIG. 1 is a top plan view of the boat cleaning apparatus.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a top view of the boat cleaning apparatus 10. The cleaning apparatus 10 includes a bottom-cleaning cylindrical brush 11 and side-cleaning cylindrical brushes 12 and 13, all of which are rotatably mounted upon the frame 14. A first drive motor 15 is connected to the central shaft 16 of the bottom cleaning brush 11 by chain or drive belt 17 to drive the brush in rotation. The side cleaning brushes 12 and 13 are connected to each other by a swivel coupling (universal joint) 18 and a second drive motor 19 is connected thereto by chain or drive belt 20. Each of the drive motors is electrically connected through the switch box 21 and the electrical plug 22 to a source of electricity.

Attached to the frame 14 are wheels 23 through 26, wheels 23 and 26 being caster wheels. These wheels support the frame and the attached items, and permit the frame to be moved along the ground. Additionally, the wheels enable the apparatus 10 to be easily moved to and from the place where the boat is to be cleaned, and allow it to be properly positioned relative to the boat.

A pipe 28 for applying a cleansing solution to the surface of the boat is attached to the frame 14 and extends parallel to brush 11. The pipe 28 includes several nozzles such as 29 which are suitable for dispensing a cleansing liquid or steam against the bottom of a boat suspended above the apparatus 10. The pipe 28 has a closed end 30 and an inlet 31. A source of any suitable cleaning material may be connected to the inlet 31 and dispensed against the boat through nozzles such as 29.

Figure 4:
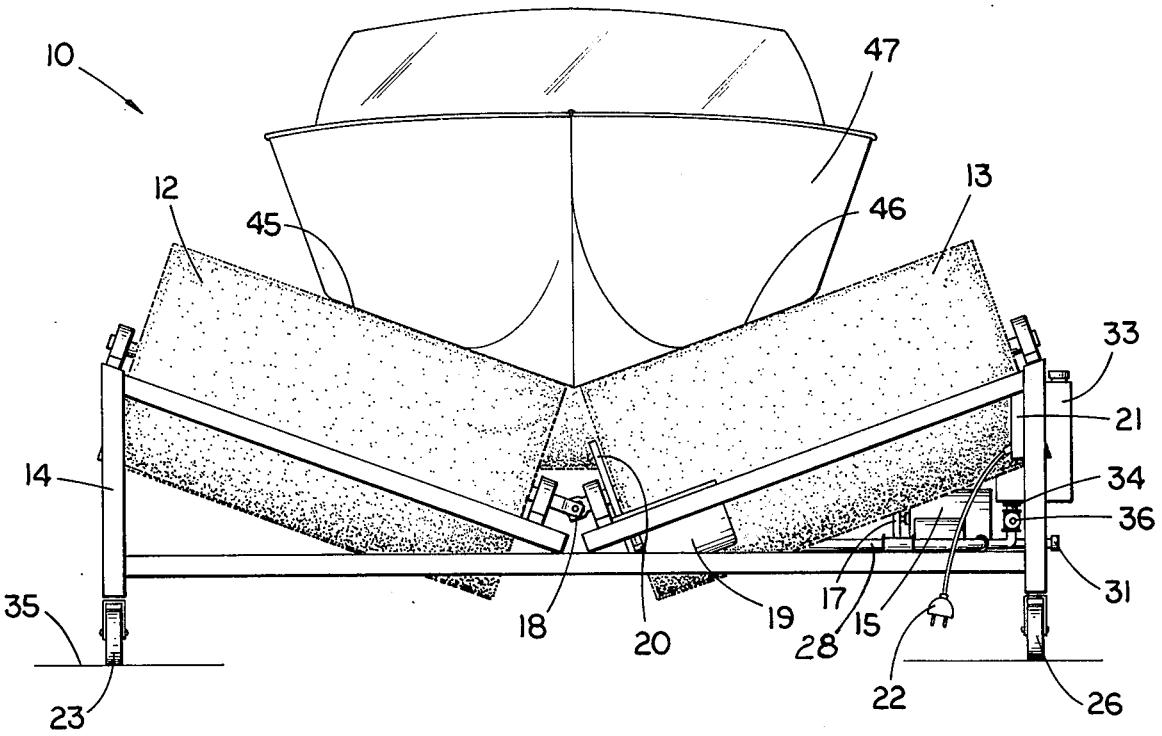
FIG. 4 is a front elevational view of the boat cleaning apparatus and a boat positioned above it.

Depending on the condition of the boat exterior, the cleansing solution may be steam, water, or water in combination with a detergent or an acid. For dispensing an aqueous solution of cleansing material, the water source is connected to the inlet 31 and is pumped into pipe 28 by water pump 32. Tank 33 is filled with the desired cleansing material such as an acid or a detergent, and tank 33 is sealed and pressurized. The acid or detergent is then admitted into pipe 28 through the feed line 34. The pressure within tank 33 prevents the water being pumped through the pipe 28 from entering the tank through the feed line 34. A valve 36 (FIG. 4) located in feed line 34 below tank 33, is used to regulate the flow of acid or detergent from tank 33 into pipe 28, while prohibiting the water from flowing into tank 33. Thus, the water serves as a carrier for the cleaner concentrate (acid or detergent, for example) to the nozzles.

Figure 2:
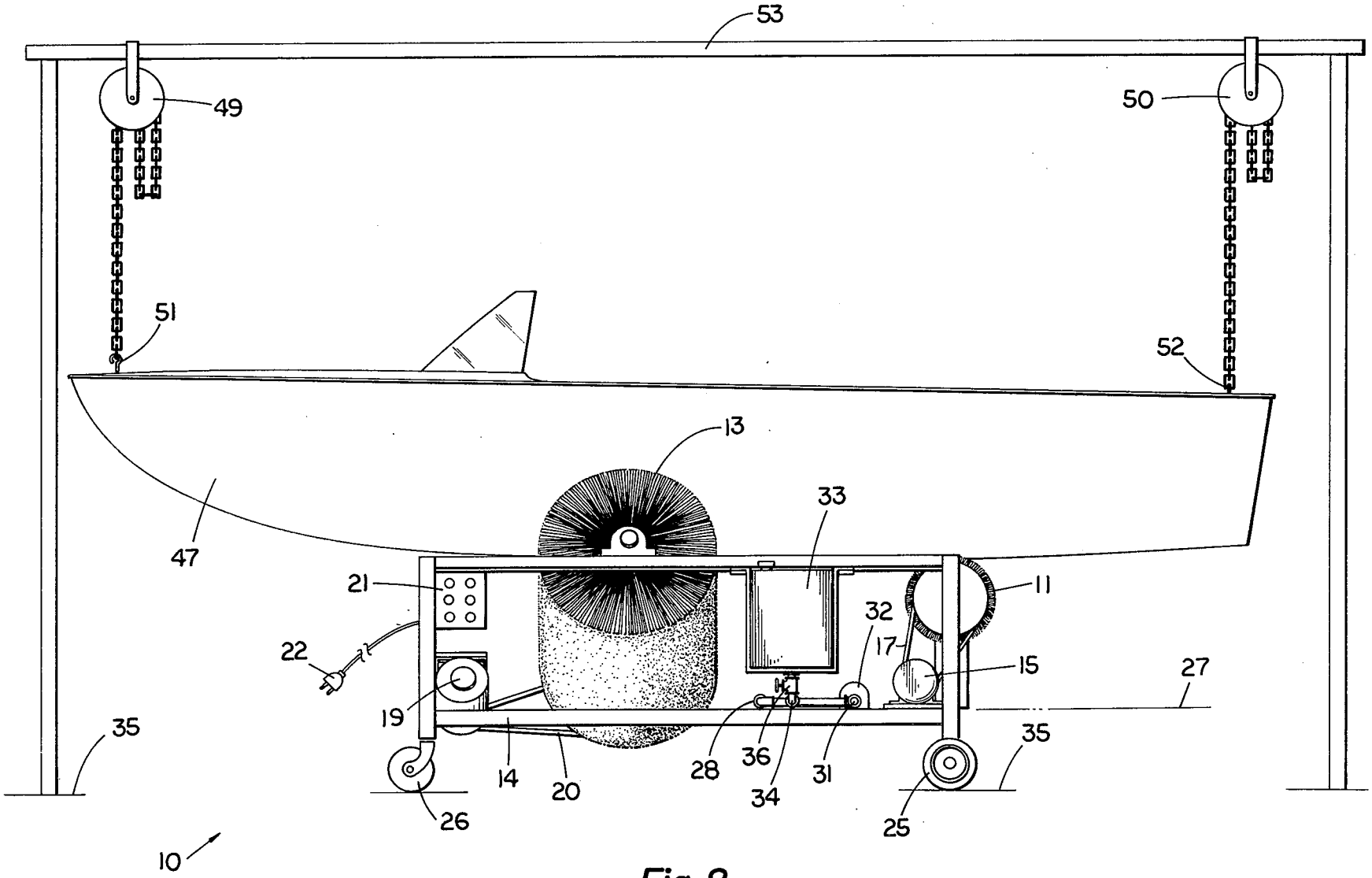
FIG. 2 is a side elevational view of the boat cleaning apparatus with a boat suspended above it.

Referring now to FIG. 2, there is shown boat 47 suspended over the boat cleaning apparatus 10. The boat is suspended by chain pulleys 49 and 50 which raise the boat 47 by eye hooks 51 and 52, respectively. The pulleys are attached to framework 53. Boat cleaning apparatus 10 includes bottom cleaning brush 11 and side cleaning brush 13 rotatably mounted upon the frame 14. The cleaning brushes are driven by first and second drive motors 15 and 19, respectively. Each drive motor is connected to a source of electricity through switch box 21 and electrical plug 22. The frame and attached items are supported upon wheels such as 25 and 26, and are thereby operable to be moved along the ground 35 along the first dimension 27.

Figure 3:
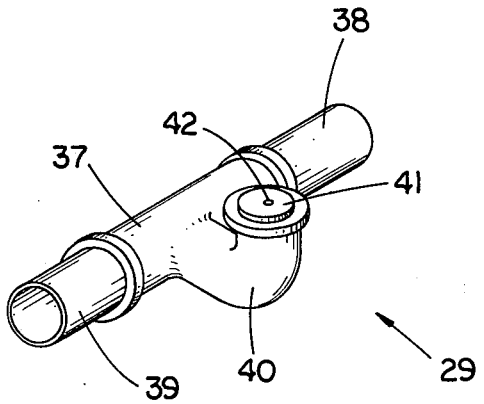
FIG. 3 is a perspective view of a nozzle used in the boat cleaning apparatus for dispensing a cleansing liquid against the exterior of the boat.
Figure 5:
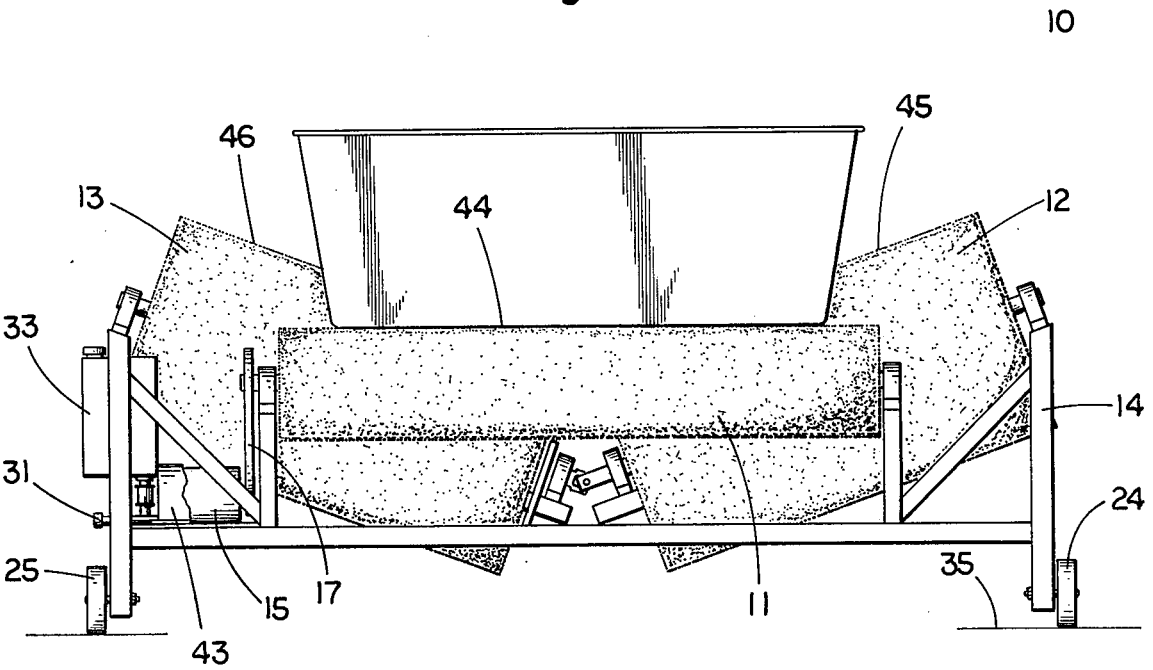
FIG. 5 is a rear elevational view of the boat cleaning apparatus and a boat positioned above it.

Depicted in detail in FIG. 3 is one of the several identical nozzles spaced along pipe 28, and used for dispensing the cleansing material against the exterior of the boat. The nozzle 29 includes a generally T-shaped pipe 37 which is connected in series with the other T-shaped pipes of the several nozzles. Pipe 37 is connected with portions 38 and 39 of pipe 28 and has an elbow portion 40. A plug 41 is sealingly received in the end of the elbow portion 40, and a hole 42 is drilled through the plug 41. The cleansing material enters through pipe 28 and fills the pipe running between the nozzles. The pressure of the cleansing material causes it to enter pipe elbow 40 and to be ejected through hole 42 in plug 41. The pressure in the system causes the cleansing material to be ejected at a sufficient rate and with sufficient force to contact the exterior of the boat suspended above the apparatus. Chain and motor covers, such as fragmentarily shown at 43 in FIG. 5 for the motor, can be employed to protect them from the cleansing material.

The bottom and side cleaning brushes are positioned to contact not only the bottom of boat 47, which is positioned above the frame 14, but brushes 12 and 13 will also extend up the sides to the water line. Each of the brushes includes an exterior cylindrical surface which will scrub the exterior of the boat 47 when the brushes are rotated adjacent the boat. When the boat is positioned above the boat cleaning apparatus, the top portions of each of the cleaning brushes, as indicated at items 44 through 46, will be constantly in contact with the exterior of the boat while the brushes are rotated.

In operation, the boat is cleaned by the cleaning apparatus 10 by first suspending the boat in the air at the proper elevation. The proper elevation is that which positions the boat so that the brushes of the boat cleaning apparatus 10 will contact the exterior of the boat when the apparatus 10 is moved below the boat and brushes 12 and 13 will work the surface up to the waterline. The desired cleansing material source is then connected to the apparatus 10. For example, a water tap may be connected through a hose to the inlet 31. In addition, the detergent or acid may be added to tank 33, with the tank being sealed and pressurized. The flow of the water is then controlled at the tap and the flow of the acid or detergent is controlled by valve 36, each flow being regulated to attain the desired concentration of the acid or detergent and to obtain the proper flow of materials against the bottom of the boat. The first and second drive motors, 15 and 19 respectively, are then connected to an electrical source, and are activated at the switch box 21. The apparatus is positioned at one end of the boat, and is then moved the length of the boat parallel to the first dimension of the frame 14. As the apparatus 10 is moved the length of the boat, the bottom and side cleaning brushes are rotated by the first and second drive motors, and each portion of the boat exterior is successively cleaned by the brushes as the frame is moved along. The apparatus 10 may be passed the length of the boat as many times as required, and any suitable or required cleansing material may be used in conjunction with the brushes. Just as the cleansing material may be selected as required, the composition of the brushes may be selected as required. It will usually be suitable to use brushes which comprise a flexible synthetic material such as a plastic. Alternatively, wire brushes may be used, particularly for cleaning heavily fouled boat exteriors.

The Vee orientation of the side cleaning brush axes, and thereby of the brushes themselves, particularly well adapts them to scrubbing a Vee bottom boat, as well as to scrubbing the sides of any boat to a point above the water line. The use of uncastered wheels 24 and 25 below brush 25 prevents any sideward roll of the machine frame at this location while the use of caster wheels at the opposite end of the frame, with the Vee angled brushes being nearer the castered than the non-castered wheels, permits steering of the frame and facilitates centering the inclined brushes on a Vee bottom without swinging the boat literally from a vertical line through the hoist 49, for example.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. Boat cleaning equipment which comprises:

a frame having a first dimension parallel to the longitudinal axis of a boat suspended above it;

bottom-cleaning means mounted upon said frame for cleaning the bottom of a boat, said bottom cleaning means having a bottom cleaning surface at least a portion of which is positioned to contact the bottom of a boat suspended above it, the bottom cleaning surface being movable relative to a boat suspended adjacent thereto and relative to said frame;

first drive means for moving the bottom cleaning surface relative to a boat suspended adjacent thereto and relative to said frame;

side cleaning means mounted upon said frame for cleaning the sides of a boat, said side cleaning means having side cleaning surfaces, at least a portion of which are positioned to contact the sides of a boat suspended above the bottom cleaning surface, the side cleaning surfaces being movable relative to a boat suspended adjacent thereto and relative to said frame;

second drive means for moving the side cleaning surfaces relative to a boat suspended adjacent thereto and relative to said frame; and roller means operable on a stationary surface to facilitate moving said frame along the first dimension of said frame parallel to the longitudinal axis of a boat suspended above the bottom cleaning surface.

2. The boat cleaning equipment of claim 1 in which said roller means includes several wheels attached to and supporting said frame, the wheels being operable on a ground or floor under the boat.

3. The equipment of claim 1 and further comprising:

suspending means for suspending a boat in the air above the bottom cleaning means.

4. The combination of claim 3 in which the bottom cleaning surface comprises a cylindrical bottom cleaning brush rotatably attached to said frame, and the side cleaning surfaces comprise a pair of cylindrical side-cleaning brushes rotatably attached to said frame on Vee inclined axes.

5. The combination of claim 4 in which said roller includes several wheels attached to and supporting said frame, two of the wheels being uncastered wheels adjacent the bottom cleaning brush, and the wheels being caster wheels adjacent said pair of brushes and operable to facilitate steering said frame as it moves over the ground along the first dimension of said frame.

6. The combination of claim 4 which further comprises:

a source of steam; and nozzle means connected to said source of steam and mounted upon said frame for directing said steam against a boat suspended in the air above the bottom cleaning surface.

7. The combination of claim 4 which further comprises:

a cleansing liquid suitable for use in cleaning boats; and nozzle means attached to said frame for directing said cleansing liquid against a boat suspended in the air above the bottom cleaning surface.

8. The combination of claim 7 in which the cleansing solution comprises an aqueous acid solution.

9. The boat cleaning apparatus of claim 7 in which the roller means includes non-steerable wheels and steerable wheels attached to and supporting said frame, the steerable wheels being operable to permit steering said frame as it moves over the ground along the first dimension of said frame, and said nozzle means includes a plurality of nozzles spaced along a pipe extending transverse to said dimension and between said bottom cleaning brush and said side cleaning brushes.

10. The combination of claim 9 and further comprising:

a cleaner concentrate storage vessel on said frame;

a concentrate carrier inlet to said pipe for connection to a pressurized source external to the frame; and valved conduit means communicating between said vessel and said pipe to meter concentrate from said vessel into a carrier in said pipe for discharge from said nozzle means.

11. The combination of claim 10 and further comprising:

a pump between said inlet and said conduit for elevating pressure of fluid in said pipe supplied to said nozzle means.

* * * * *